US011015597B2

(12) United States Patent
Yamazaki et al.

(10) Patent No.: US 11,015,597 B2
(45) Date of Patent: May 25, 2021

(54) SCROLL-TYPE FLUID MACHINE AND METHOD FOR ASSEMBLING SAME

(71) Applicant: Hitachi Industrial Equipment Systems Co., Ltd., Tokyo (JP)

(72) Inventors: Shumpei Yamazaki, Tokyo (JP); Yoshiyuki Kanemoto, Tokyo (JP); Fuminori Kato, Tokyo (JP); Takanori Emi, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 183 days.

(21) Appl. No.: 16/086,829

(22) PCT Filed: Jul. 29, 2016

(86) PCT No.: PCT/JP2016/072274
§ 371 (c)(1),
(2) Date: Sep. 20, 2018

(87) PCT Pub. No.: WO2018/020651
PCT Pub. Date: Feb. 1, 2018

(65) Prior Publication Data

US 2019/0101115 A1 Apr. 4, 2019

(51) Int. Cl.
*F04C 18/02* (2006.01)
*F01C 21/00* (2006.01)
(Continued)

(52) U.S. Cl.
CPC ..... *F04C 18/0215* (2013.01); *F01C 21/007* (2013.01); *F01C 21/10* (2013.01);
(Continued)

(58) Field of Classification Search
CPC .. F04C 18/0215; F04C 29/0085; F04C 23/02; F04C 23/008; F01C 21/007; F01C 21/10
See application file for complete search history.

(56) References Cited

U.S. PATENT DOCUMENTS 5,088,906 A * 2/1992 Richardson, Jr. ... F04C 18/0215 418/55.2
5,106,279 A * 4/1992 Richardson, Jr. ... F04C 18/0215 418/55.2
(Continued)

FOREIGN PATENT DOCUMENTS

CN 204003475 U 12/2014
CN 104271955 A 1/2015
(Continued)

OTHER PUBLICATIONS

Japanese-language Office Action issued in counterpart Japanese Application No. 2018-530293 dated Nov. 19, 2019 with English translation (four (4) pages).
(Continued)

*Primary Examiner* — Deming Wan
(74) *Attorney, Agent, or Firm* — Crowell & Moring LLP

(57) ABSTRACT

The objective of the present invention is to provide a scroll-type fluid machine, and a method for assembling this scroll-type fluid machine, with which an eccentric shaft and a non-eccentric part can be positioned easily in the same step, while allowing a main body unit and a motor unit to be separated and connected without being disassembled. To achieve this objective, this scroll-type fluid machine is equipped with a main body unit having a main body casing, a fixed scroll, and an orbiting scroll, and a motor unit having a drive shaft for driving the main body unit, and a motor casing, wherein the drive shaft protrudes from the motor casing and is attached to a slewing bearing of the main body unit, positioning holes into which a positioning member is inserted are formed on their respective opposing mating surfaces of the motor casing and the main body casing, and the dimensional difference between main-body-casing-side insertion opening of the positioning hole and the motor-casing-side end surface of the slewing bearing in the axial
(Continued)

direction is less than the dimensional difference between the main-body-unit-side tip ends of the drive shaft and the positioning member in the axial direction.

17 Claims, 5 Drawing Sheets

(51) Int. Cl.
*F04C 29/00* (2006.01)
*F04C 23/02* (2006.01)
*F04C 23/00* (2006.01)
*F01C 21/10* (2006.01)

(52) U.S. Cl.
CPC ..... *F04C 23/02* (2013.01); *F04C 29/0085* (2013.01); *F04C 29/0071* (2013.01); *F04C 2240/30* (2013.01)

(56) References Cited

U.S. PATENT DOCUMENTS

| | | | | |
|---|---|---|---|---|
| 2007/0231175 | A1 | 10/2007 | Suefuji et al. | |
| 2012/0237381 | A1* | 9/2012 | Murakami | F04C 29/068 418/55.1 |
| 2013/0251568 | A1 | 9/2013 | Bush | |
| 2014/0294640 | A1 | 10/2014 | Calhoun | |
| 2015/0093269 | A1 | 4/2015 | Iwano et al. | |

FOREIGN PATENT DOCUMENTS

| | | | |
|---|---|---|---|
| CN | 204082536 | U | 1/2015 |
| JP | 2007-270764 | A | 10/2007 |
| JP | 2009-97358 | A | 5/2009 |
| JP | 2014-190245 | A | 10/2014 |
| JP | 2015-68171 | A | 4/2015 |
| JP | 2015-68245 | A | 4/2015 |

OTHER PUBLICATIONS

Chinese-language Office Action issued in counterpart Chinese Application No. 201680082554.8 dated Mar. 22, 2019 with English translation (14 pages).
International Search Report (PCT/ISA/210) issued in PCT Application No. PCT/JP2016/072274 dated Oct. 25, 2016 with partial English translation (three (3) pages).
Japanese-language Written Opinion (PCT/ISA/237) issued in PCT Application No. PCT/JP2016/072274 dated Oct. 25, 2016 (five (5) pages).
Extended European Search Report issued in counterpart European Application No. 16910554.1 dated Dec. 6, 2019 (seven (7) pages).

* cited by examiner

SCROLL-TYPE FLUID MACHINE AND METHOD FOR ASSEMBLING SAME

TECHNICAL FIELD

The present invention relates to a scroll-type fluid machine and a method for assembling the same.

BACKGROUND ART

As a background art of the present invention, there is JP 2009-97358 A (Patent Document 1). Patent Document 1 discloses "a hermetic type scroll compressor which includes a compression mechanism unit including a fixed scroll and an orbiting scroll in an hermetic case, a motor for applying a rotational driving force to the orbiting scroll via a drive shaft, an upper balancer disposed in a cylindrical orbiting space formed in a frame member on a rear side of the orbiting scroll and attached to the drive shaft, a middle balancer attached to the drive shaft or a rotary element of a rotor on an upper side of the motor, and a lower balancer attached to the drive shaft or the rotary element of the rotor on a lower side of the motor, in which a main bearing for supporting the drive shaft is mounted between the upper balancer and the middle balancer, a bearing fitting hole to which the main bearing is fitted is formed below the orbiting space of the frame member, an inner diameter of the bearing fitting hole is formed to be larger than an inner diameter of the orbiting space to coincide with an axial center of the orbiting space, and the bearing is configured to be attachable to the bearing fitting hole in a state in which the main bearing, the upper, middle and lower balancers, and the rotor of the motor are attached to the drive shaft".

CITATION LIST

Patent Document

Patent Document 1: JP 2009-97358 A

SUMMARY OF THE INVENTION

Problems to be Solved by the Invention

The hermetic type scroll compressor 1 of Patent Document 1 is provided on a frame member 7 to which a bearing fitting hole 100 with a main bearing 43 fitted thereto is bolted to a fixed scroll 17. Axial centers of a compression mechanism unit 9 and a motor 13 are determined by fitting between the bearing fitting hole 100 and the main bearing 43, but since the bearing fitting hole 100 is provided in the compression mechanism unit 9, it is not easy to separate and connect the compression mechanism unit 9 and the motor 13.

Therefore, if the bearing fitting hole 100 is provided in a motor frame 53, the compression mechanism unit 9 and the motor 13 can be easily separated and connected. In this case, even in the scroll-type compressor 1 in which the motor 13 is built in, all of the compression mechanism unit 9, the motor 13, and their connections can be performed at different factories and places. Further, if the main bearing is provided in the motor frame 53, regardless of whether the motor 13 is a built-in scroll-type compressor 1, the compression mechanism unit 9 and the motor 13 can be operated as a single unit, and the operation can be checked.

However, if the bearing fitting hole 100 is provided in the motor frame 53, while aligning the axial center of the orbiting scroll freely rotatable on a certain orbiting radius with an axial center of a shaft eccentric part similarly freely rotatable on the same radius, apart from orbiting scroll, it is necessary to position the compression mechanism unit 9 and the motor 13 with uniquely fixed positions, which deteriorates the assembling performance.

In view of the above problem, an object of the present invention is to provide a scroll-type compressor in which the main body unit and the motor unit can be separated and connected without being disassembled, while positioning of the eccentric shaft and the non-eccentric part can be performed easily in the same process and a method for manufacturing the same.

Solutions to Problems

In order to solve the above problem, the present invention provides, for example, a scroll-type fluid machine which includes a main body unit having a main body casing, a fixed scroll, and an orbiting scroll provided to face the fixed scroll to make an orbiting motion; and a motor unit having a drive shaft connected to the main body unit to drive the main body unit and a motor casing. The drive shaft protrudes from the motor casing and is attached to a sieving bearing of the main body unit. The motor casing and the main body casing have positioning holes into which a positioning member is inserted on respective mating surfaces. A dimensional difference in an axial direction between an insertion port of the positioning hole on the main body casing side and an end surface of the slewing bearing on the motor casing side is configured to be smaller than a dimensional difference in the axial direction of a tip end on the main body unit side between the drive shaft and the positioning member.

Effects of the Invention

According to the present invention, it is possible to provide a scroll-type compressor in which the main body unit and the motor unit can be separated and connected without being disassembled, while positioning of the eccentric shaft and the non-eccentric part can be performed easily in the same process and a method for manufacturing the same.

MODE FOR CARRYING OUT THE INVENTION

A first example of the present invention will be described below with reference to the drawings.

First Example

Figure 1:
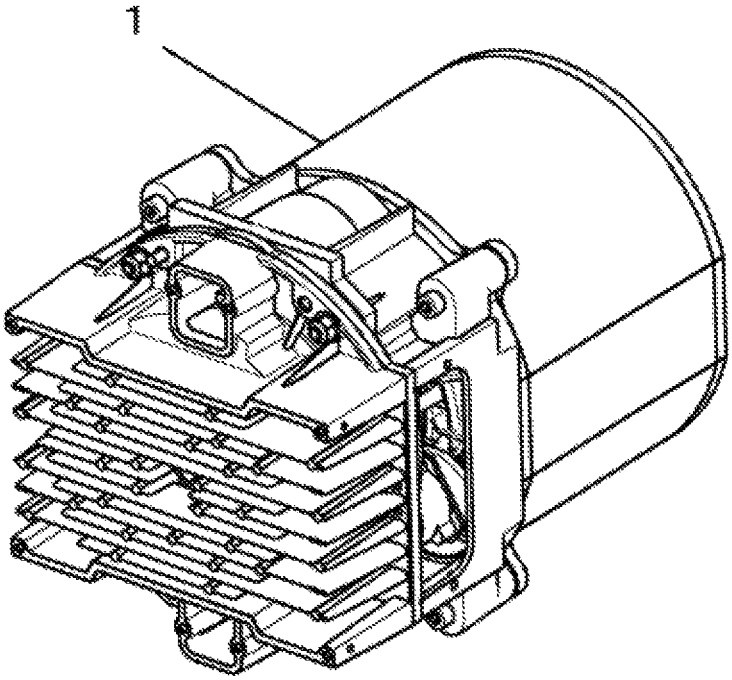
FIG. 1 is an overall view of a scroll-type fluid machine according to a first example.
Figure 2:
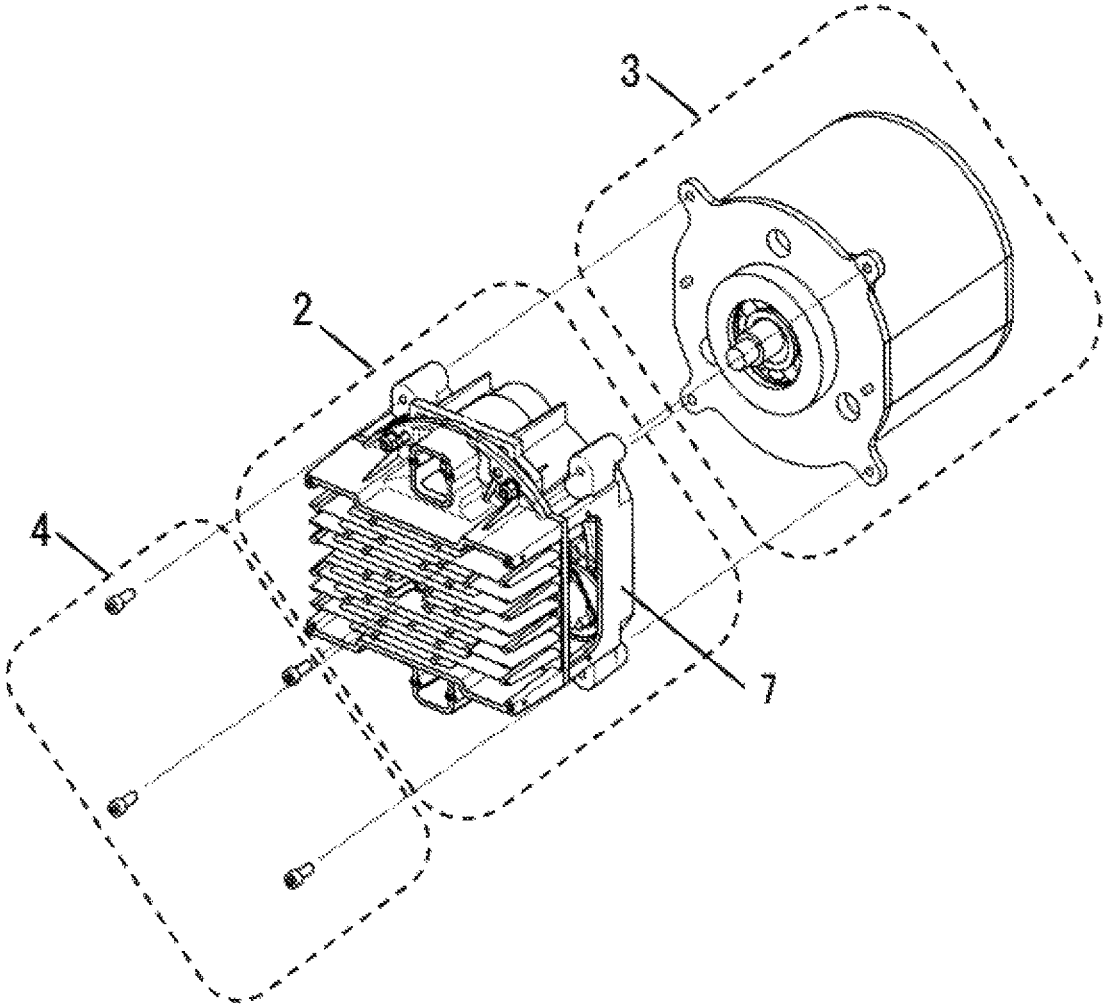
FIG. 2 is a separated view of a main body unit and a motor unit of the scroll-type fluid machine according to the first example.

FIG. 1 illustrates an overall schematic view of a scroll-type fluid machine in this example, and FIG. 2 illustrates a constitution diagram in which a main body unit and a motor unit of the scroll-type fluid machine are separated from each other.

The scroll-type fluid machine illustrated in FIG. 1 may be a scroll-type compressor which compresses specific gas or refrigerant such as air or nitrogen, or may be a scroll-type vacuum pump. The scroll-type fluid machine 1 includes a main body unit 2 and a motor unit 3 for driving the main body unit 2, and both of them are fastened by a fastening member 4.

Figure 3:
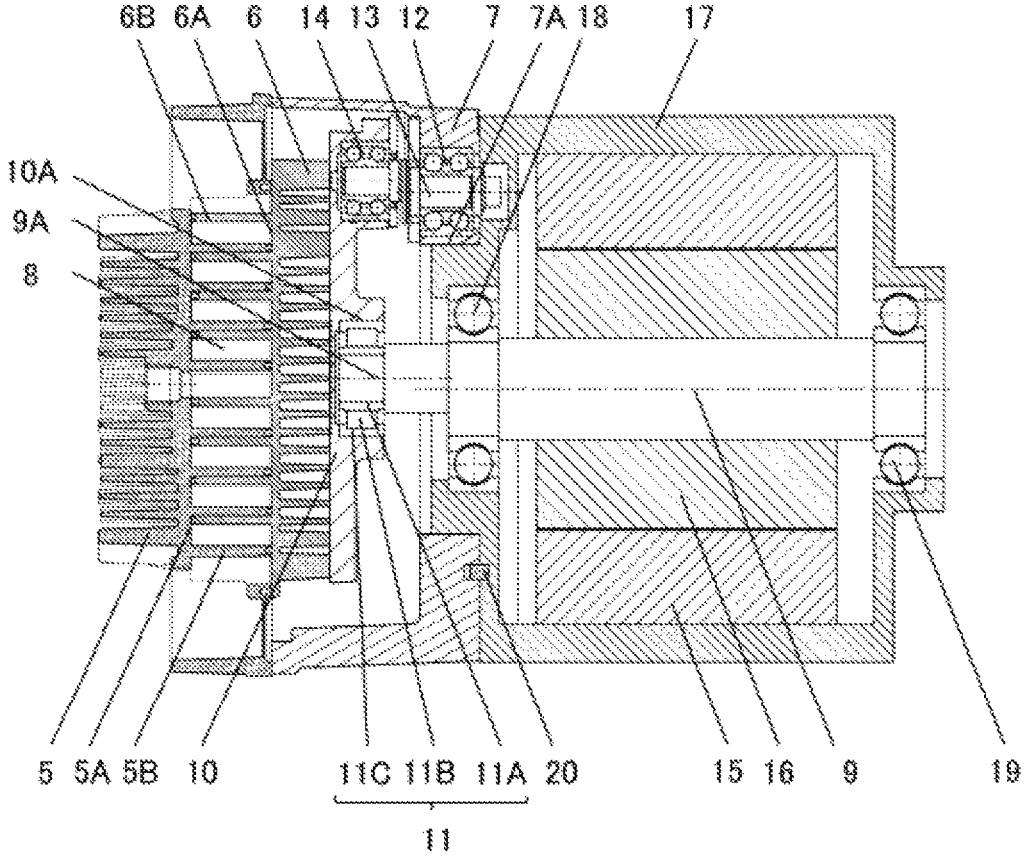
FIG. 3 is a side cross-sectional view of the scroll-type fluid machine according to the first example.

FIG. 3 illustrates an example of a cross-sectional view of a scroll-type fluid machine 1 in FIG. 1 as seen from the side. As illustrated in FIG. 3, an internal structure of the main body unit 2 is constituted by a fixed scroll 5, an orbiting scroll 6 disposed to face the fixed scroll 5, and a main body casing 7 for covering the orbiting scroll 6 from an outer side in a radial direction. In the fixed scroll 5 and the orbiting scroll 6, spiral wrap parts 5B and 6B are formed on the surfaces of the end plates 5A and 6A, respectively. A compression chamber 8 is formed by overlapping wrap parts 5B and 6B of the fixed scroll 5 and the orbiting scroll 6. The main body casing 7 has a tubular shape, and both ends thereof are open. The fixed scroll 5 is attached to an opening portion on one end side of the main body casing 7, and the motor unit 3 is attached to an opening portion 7A on the other end side. The orbiting scroll 6 is driven by the motor unit 3 and makes an orbiting motion. In the main body unit 2, the compression chamber 8 defined between the wrap part 5B of the fixed scroll 5 and the wrap part 6B of the orbiting scroll 6 by the orbiting motion of the orbiting scroll 6 is continuously contracted to compress and discharge the fluid. Incidentally, in the present example, the scroll-type fluid machine 1 having only a pair of the fixed scroll 5 and the orbiting scroll 6 has been described as an example, but a configuration which includes the orbiting scroll 6 having the wrap part 6B on both sides of the end plate 6A and has the fixed scroll 5 on both sides thereof may be provided. The orbiting scroll 6 includes a boss portion 10A that accommodates a shaft 9 of the motor unit 3 on a rear side (a side opposite to a surface on which the wrap part 6B is formed) of the end plate 6A.

As illustrated in FIG. 3, the boss portion 10A may be formed on a back side (a surface opposite to the orbiting scroll 6) of a boss plate 10 by providing the boss plate 10 at a position separated from the back side of the end plate 6A, and may be directly formed on the back side of the end plate 6A of the orbiting scroll 6.

A orbiting bearing 11 (11A, 11B, and 11C) which supports a centrifugal force generated by the orbiting motion of the orbiting scroll 6 and a gas load generated by compressing the air is formed in a boss portion 10A provided on the back side of the orbiting scroll 6.

A plurality of rotation preventing mechanisms for preventing rotation motion of the orbiting scroll 6 is provided between the main body casing 7 and the orbiting scroll 6. The rotation preventing mechanism prevents the rotation motion of the orbiting scroll 6, and supports the gas load in an axial direction from the orbiting scroll 6. The rotation preventing mechanism includes an auxiliary crankshaft 13 in which two eccentric shafts are integrally formed in the axial direction, are held in the radial direction by a main casing side auxiliary crank bearing 12 and rotate following the orbiting scroll 6 to prevent rotation of the orbiting scroll 6, an orbiting scroll side auxiliary crank bearing 14 which supports the auxiliary crankshaft 13 and is accommodated in the orbiting scroll 6, and a main casing side auxiliary crank bearing 12 accommodated in the main body casing 7. Incidentally, as a rotation preventing mechanism, instead of the auxiliary crank mechanism described here, for example, a ball coupling mechanism, an Oldham coupling or the like may be used.

As illustrated in FIG. 3, the motor unit 3 includes a stator 15 and a rotor 16 that generate power, and a shaft 9 that integrates the rotor 16 by press fitting or the like and transmits the power to the outside. As the stator 15 applies rotational force to the rotor 16, the shaft 9 integrated with the rotor 16 rotates. The shaft 9 has an eccentric part 9A, the eccentric part 9A is accommodated in a boss portion 10A provided on the back side of the orbiting scroll 6 when assembling the main body unit 2 and the motor unit 3 and is attachably and detachably connected to the main body unit 2. The eccentric part 9A of the shaft 9 performs an eccentric motion with turning motion of the shaft 9. Therefore, as the shaft 9 turns, the orbiting scroll 6 connected to the eccentric part 9A makes an orbiting motion. Further, the motor unit 3 has a stator 15 and a motor casing 17 for accommodating the rotor 16. The motor casing 17 may be divided into a plurality of components. The motor casing 17 is fixed to the stator 15 and accommodates the stator 25 and the rotor 16. The shaft 9 is supported by an output side bearing 16 and a counter output side bearing 19. The output side bearing 18 and the counter output side bearing 19 are disposed coaxially so that the shaft 9 is not inclined with respect to the axis of the output side bearing 18 and the counter output side bearing 19. This suppresses vibrations generated by the inclination of the shaft 9 at the time of the operation of the scroll-type fluid machine 1, suppresses an unbalanced load on the orbiting bearing 11, and prevents a decrease in the service life of the orbiting bearing 11.

Here, when the eccentric part 9A of the shaft 9 is provided in the main body unit 2, it is necessary to fasten the shaft 9 and the eccentric part 9A using a shaft fastening member such as a coupling. That is, the misalignment occurring between an orbiting center axis of the orbiting scroll 6 and the axial center of the shaft 9 can be mitigated and adjusted by the shaft fastening member. However, in that case, there is a problem that the number of components increases, the number of processes increases, and an axial dimension length becomes longer. Therefore, it is conceivable to adopt a configuration in which the eccentric part 9A of the shaft 9 is provided in the motor unit 3. However, with this configuration, it is necessary to position the main body unit 2 and the motor unit 3, while aligning the axial center between the orbiting bearing 11 and the eccentric part 9A of the shaft 9, which causes a problem of deteriorating the assembling performance. It is necessary to solve this problem.

The positioning member 20 is a member for accurately positioning the main body unit 2 and the motor unit 3, and is made separate from the fastening member 4. By separating the positioning member 20 and the fastening member 4, deformation of the positioning part generated by the fastening member 4 at the time of fastening the main body unit 2 and the motor unit 3 and core misalignment caused thereby are prevented. The fastening member 4 has screw grooves on its surface, but the positioning member 20 does not have screw grooves on its surface.

Next, a positional relation between the positioning member 20 and the shaft 9 will be described. In the scroll-type fluid machine 1 having the eccentric part 9A of the shaft 9 provided in the motor unit 3, when connecting the main body unit 2 and the motor unit 3, it is necessary to align the positions of the centers of the eccentric part 9A and the orbiting scroll wrap part 6B, and align the positions of the main body unit 2 and the motor unit 3.

When positioning of the main body unit 2 and the motor unit 3 is made loose, a positioning jig is required when assembling and reassembling ac the time of maintenance. When positioning of the eccentric part 9A and the center of the orbiting scroll wrap part 6B, and positioning of the main body unit 2 and the motor unit 3 are performed at the same time, for example, a jig for restricting the turning of the eccentric part 9 and the orbiting scroll 6 is required.

When positioning the main body unit 2 and the motor unit 3 is performed earlier than positioning of the eccentric part 9A and the center of the orbiting scroll wrap part 6B, a dimension of the positioning member 20 in the axial direction of the shaft 9 direction becomes longer, and it is difficult to visually observe a orbiting bearing outer ring 11C in the orbiting bearing 11. Therefore, there are problems in which it is necessary to position the orbiting bearing outer ring 11C before connecting the positioning member 20 and it is difficult to adjust the position of the orbiting bearing outer ring 11C after connecting the positioning member 20. In addition, since a contact area between the positioning member 20 and the positioning hole 7B increases, the friction at the positioning part when connecting the main body unit 2 and the motor unit 3 increases, and the workability is deteriorated.

Figure 4:
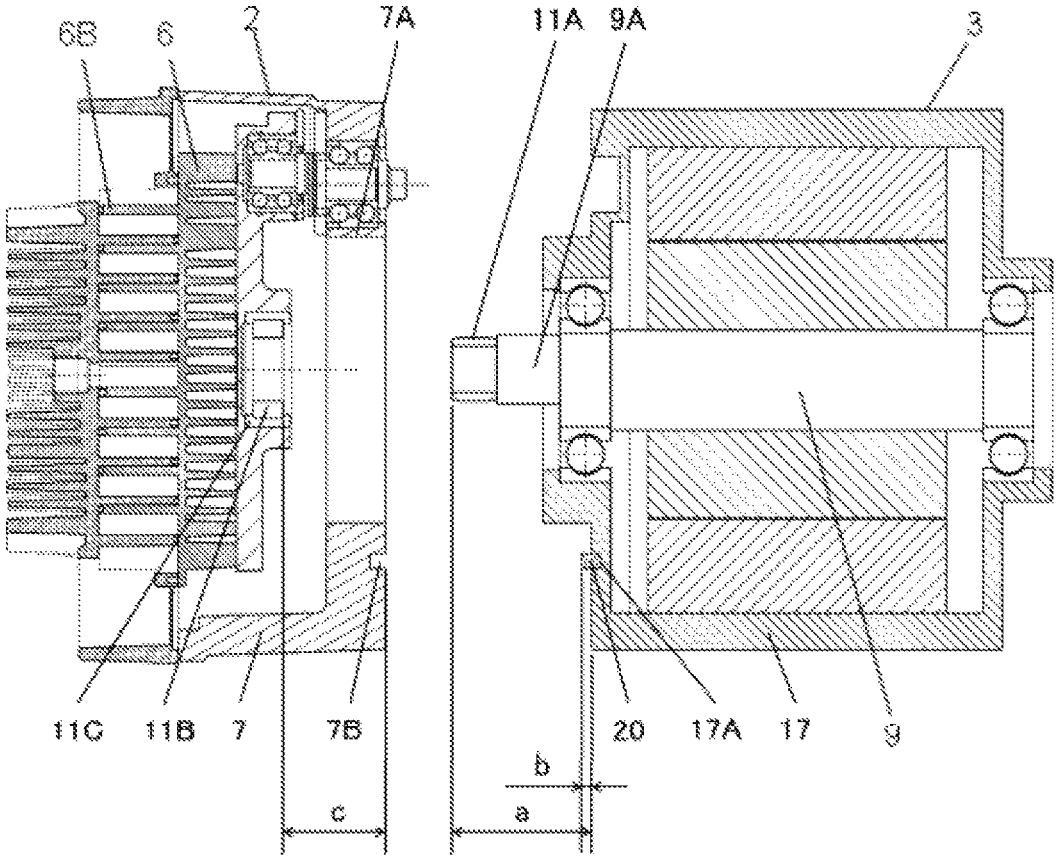
FIG. 4 is a side cross-sectional view in a separated state of the main body unit and the motor unit of the scroll-type fluid machine according to the first example.

Therefore, by adopting a positioning structure illustrated in FIG. 4, workability can foe improved. FIG. 4 is a cross-sectional side view in a separated state of the main body unit 2 and the motor unit 3 of the scroll-type fluid machine 1 in this example. In FIG. 4, a protruding dimension of the shaft 9 from an entrance of a positioning hole 17A provided in the motor casing 17 is defined as a, a length of the positioning member 20 protruding from the entrance of the positioning hole 27A is defined as b, and a distance from an entrance of a positioning hole 7B provided in the main body casing 7 to an end surface of the orbiting bearing roller 11B on an insertion side of the shaft 9 is defined as c.

When the shaft insertion side end surface of the orbiting bearing roller 11B is closer to the motor side than the entrance of the main body casing positioning hole 7B, a relation of formula (1) or (2) is established. Also, when the shaft insertion side end surface of the orbiting bearing roller 11B is on a side opposite to the motor from the entrance of the main body casing positioning hole 7B, a relation of formula (3) is established.

$$a+b<c \quad (1)$$

$$a>b \quad (2)$$

$$a-b>c \quad (3)$$

When positioning the eccentric part 9A and the center of the orbiting scroll wrap part 6B, as a substantial work, positioning of the orbiting bearing 11 and the eccentric part 9A is performed. If it is constituted by the dimensions determined by the formulas (1), (2) and (3), when the main body unit 2 and the motor unit 3 are connected to each other, a tip end of the eccentric part 9A is first inserted into the orbiting bearing 11, and then positioning member 20 is connected to the positioning hole 7B. In a state in which the tip end of the eccentric part 9A is inserted into the orbiting bearing 11, the main body unit 2 can perform an orbiting motion about the axial center of the shaft 9 of the motor unit 3. Therefore, the positioning member 20 and the positioning hole 7B can be positioned in a state in which the relative position between the orbiting scroll 6 and the eccentric part 9A is determined, a jig is not necessary, the connection between the main body unit 2 and the motor unit 3 can be performed in the same process, and the assembling performance is improved.

Incidentally, in the drawing of this example, the orbiting bearing 11 is a roller bearing, but it may be a ball bearing or a sliding bearing. In the case of the ball bearing or the sliding bearing, a distance from the entrance of the positioning hole 7B provided in the main body casing 7 to the ball bearing inner ring or the end surface of the sliding bearing on the side of the motor unit 3 is defined as c.

Further, instead of using the positioning member 20, a protruding part may be provided on the main body casing 7 or the motor casing 17. By using a protruding part instead of the positioning member, it is possible to reduce the number of components and to improve workability.

Further, instead of using the positioning member 20, a spigot may be provided in the main body casing 7 and the motor casing 17. This makes it possible to prevent deformation of the positioning member 20 due to the own weight of the main body unit 2 or the motor unit 3 being applied to the positioning member 20 when separating the main body unit 2 and the motor unit 3.

Further, the positioning member 20 may be a positioning pin. If it is a positioning pin, it can be exchanged when the surface of the positioning part is worn. Furthermore, workability is improved by making the positioning pin a tapered pin.

The number of the positioning members 20 may be two or more, and a length h of the positioning member 20 may be different. In that case, a protruding length b of the positioning member 20 uses the length of the longest positioning member 20 in formulas (1), (2) and (3). If the length of the positioning member 20 is different, there is no need to simultaneously connect the plurality of positioning members 20, and workability is improved.

Further, the positioning member 20 may be fixed to the positioning hole 7B provided in the main body unit 2 or may be fixed to the positioning hole 17A provided in the motor unit 3. In a case where the plurality of positioning members 20 is provided, one or more positioning members 20 may be provided in the positioning hole 7B provided in the main body unit 2, and one or more positioning members 20 may be provided in the positioning hole 17A provided in the motor unit 3.

Further, the positioning member 20 may be a stepped pin having a large-diameter part and a small-diameter part shorter in the radial direction than the large-diameter part. Therefore, there is an effect in which it is possible to reduce the space of the positioning hole into which the positioning member 20 is inserted, and positioning in the axial direction can also be performed.

Further, the positioning hole 7B of the main body casing 7 is disposed on the outer side in the radial direction than the rotation preventing mechanism for preventing rotation of the orbiting scroll. This further improves the assembling performance.

In this way, the present example is a scroll-type fluid machine which includes a main body unit having a main body casing, a fixed scroll and an orbiting scroll provided to face the fixed scroll to make an orbiting motion; and a motor unit having a drive shaft connected to the main body unit to drive the main body unit and a motor casing, wherein the drive shaft protrudes from the motor casing and is attached to a slewing bearing of the main body unit, the motor casing and the main body casing have positioning holes into which each of positioning members are inserted on respective facing mating surfaces, and a dimensional difference in an axial direction between an insertion port of the positioning hole on the main body casing side and an end surface of the slewing bearing on the motor casing side is configured to be smaller than a dimensional difference in the axial direction of a tip end on the main body unit side between the drive shaft and the positioning member.

Moreover, provided is a scroll-type fluid machine which includes a main body unit having a main body casing, a fixed scroll and an orbiting scroll provided to face the fixed scroll to make an orbiting motion; and a motor unit having a drive shaft connected to the main body unit to drive the main body unit and a motor casing, wherein the drive shaft protrudes from the motor casing and is attached to a slewing bearing of the main body unit, the motor casing and the main body casing have positioning holes into which the positioning member is inserted on respective mating surfaces, and a dimensional difference in the axial direction between the end surface of the slewing bearing on the motor casing side and the insertion port of the positioning hole on the main body casing side is configured to be smaller than a difference between a protruding dimension of the drive shaft in the axial direction from an insertion port of the positioning hole on the motor casing side and a protruding dimension of the positioning member from the insertion port of the positioning hole on the motor casing side or on the main body casing side.

Further, a method for assembling a fluid machine having a main body unit which expands or compresses a fluid and a motor unit which drives the main body unit, wherein after inserting the drive shaft of the motor unit into the main body unit, the positioning member is inserted into a positioning hole of the motor unit or the main body unit to perform positioning.

Therefore, it is possible to provide a scroll-type fluid machine and a method for assembling the same capable of performing the positioning of the eccentric shaft and the non-eccentric part easily and in the same process, while being capable of separating and connecting the main body unit and the motor unit in a non-disassembled state.

Second Example

Figure 5:
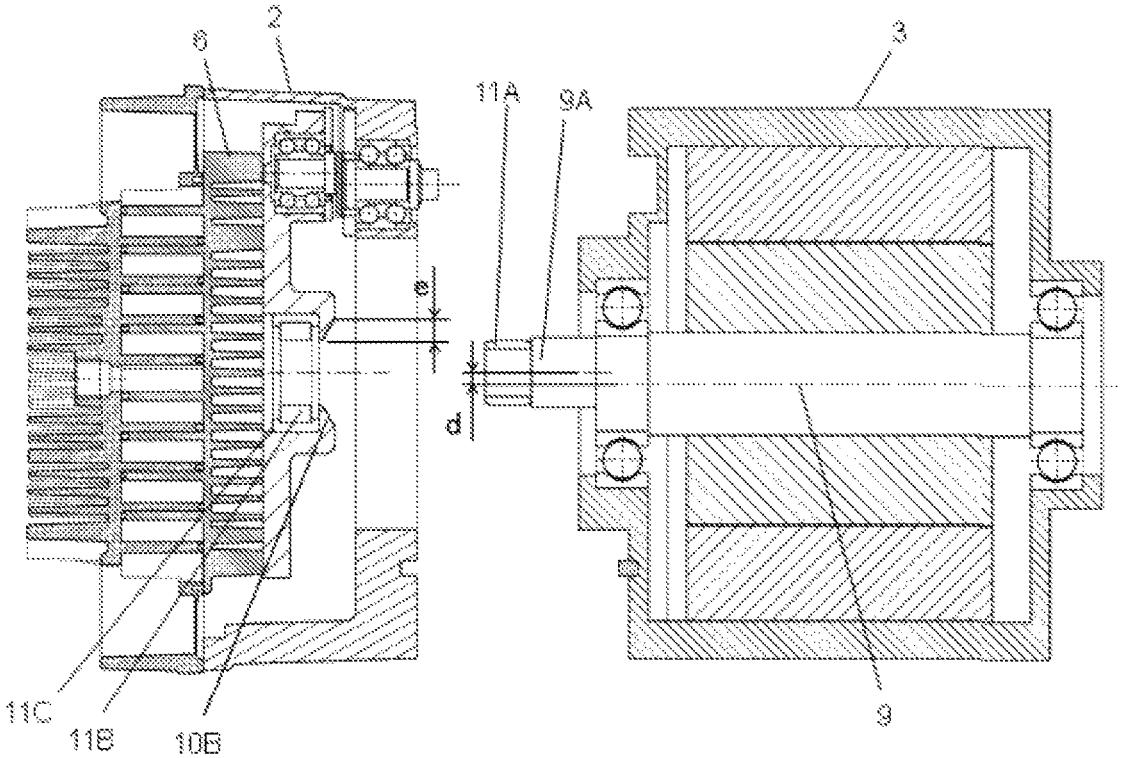
FIG. 5 is a side cross-sectional view in a separated state of the main body unit and the motor unit of the scroll-type fluid machine according to a second example.

FIG. 5 is a cross-sectional side view in a separated state of the main body unit and the motor unit of the scroll-type fluid machine in this example. The same constituent elements as those in FIG. 4 of the first example are denoted by same reference numerals, and the repeated thereof will not be provided. The orbiting bearing 11 (11A, 11B, and 11C) and the eccentric part 9A are attached to the main body unit 2 or the motor unit 3, to be movable on the circumference of the radius d around the orbiting center of the orbiting scroll 6 or the axial center of the shaft 9. In the first example, it is necessary to first insert the leading end of the eccentric part 9A into the orbiting bearing 11, and it is necessary to align the positions of the orbiting bearing 11 and the eccentric part 9A movable on the circumference of the radius d around the axial center of the shaft 9. Therefore, by providing the shaft insertion guide part 10B for guiding the shaft 9 to the orbiting bearing 11 on the side closer the motor unit 3 than the orbiting bearing 11 of the boss plate 10, it is possible to further improve the workability. The shaft insertion guide part 10B has an inner diameter equal to or larger than the inner diameter of the orbiting bearing roller 11B, and has a chamfer of a width e. The width e is set to formula (4) when the eccentricity of the eccentric part 9A is defined as d.

$$e \geq 2d \quad (4)$$

By setting the width of the chamfer of the shaft insertion guide part 10B to the formula (4), if the axial center of the main body unit 2 and the axial center of the motor unit 3 are roughly aligned and connected, the positions of the eccentric part 9A and the orbiting bearing 11 are aligned with each other.

Incidentally, in FIG. 5, the chamfer has the width e, but the surface of the shaft insertion guide part 10B may have a curved surface shape.

Although the examples have been described above, the present invention is not limited to the examples described above, but includes various modified examples. For example, the above-described examples have been described in detail in order to explain the present invention in an easy-to-understand manner, and are not necessarily limited to those having all the configurations described. Further, it is also possible to add the configuration of another example to the configuration of one example. Further, it is possible to add, delete, and replace other configurations for some of each example.

REFERENCE SIGNS LIST

1 Scroll-type fluid machine
2 Main body unit
3 Motor unit
4 Fastening member
5 Fixed scroll
5A Fixed scroll end plate
6B Fixed scroll wrap part
6 Orbiting scroll
6A Orbiting scroll end plate
6B Orbiting scroll wrap part
7 Main body casing
7A Main body casing opening portion
7B Main body unit side positioning hole
8 Compression chamber
9 Shaft
9A Eccentric part
10 Boss plate
10A Boss portion
10B shaft insertion guide part
11 Orbiting bearing
11A Orbiting bearing inner ring
11B Orbiting bearing roller
11C Orbiting bearing outer ring
12 Main body casing-side auxiliary crank bearing
13 Auxiliary crankshaft
14 Orbiting scroll side auxiliary crank bearing
15 Stator
16 Rotor
17 Motor casing
17A Motor casing side positioning hole
18 Output-side bearing
19 Counter output side bearing
20 Positioning member

The invention claimed is:

1. A scroll-type fluid machine comprising: a main body unit having a main body casing, a fixed scroll, and an orbiting scroll provided to face the fixed scroll to make an orbiting motion; and a motor unit having a drive shaft connected to the main body unit to drive the main body unit and a motor casing, wherein the drive shaft protrudes from the motor casing and is attached to a slewing bearing of the main body unit, the motor casing and the main body casing have positioning holes into which a positioning pin is inserted on respective mating surfaces, and a dimensional difference in an axial direction between an insertion port of the positioning hole on a main body casing side and an end surface of the slewing bearing facing a motor casing side is configured to be smaller than a dimensional difference in the axial direction between a tip end of the drive shaft on a main body unit side and a tip end of the positioning pin on the main body unit side.

2. The scroll-type fluid machine according to claim 1, wherein the drive shaft is attached to the slewing bearing via an eccentric part, and the eccentric part is provided on the motor unit side.

3. The scroll-type fluid machine according to claim 1, wherein a plurality of positioning pins and a plurality of positioning holes are provided in each of the motor casing and the main casing.

4. The scroll-type fluid machine according to claim 3, wherein a dimensional difference in the axial direction between the end surface of the slewing bearing facing the motor casing side and the insertion port of the positioning hole on the main body casing side is smaller than a dimensional difference in the axial direction between the tip end of the drive shaft on the main body unit side and the tip end of the positioning pin protruding most from the positioning hole on the main body unit side.

5. The scroll-type fluid machine according to claim 1, wherein the positioning pin is a stepped pin having a large-diameter part and a small-diameter part having a radial length shorter than the large-diameter part.

6. The scroll-type fluid machine according to claim 1, wherein the positioning hole of the main body casing is disposed separate from a rotation preventing mechanism which prevents rotation of the orbiting scroll.

7. The scroll-type fluid machine according to claim 1, wherein the positioning pin does not have a screw groove.

8. The scroll-type fluid machine according to claim 1, wherein a fastening member which fastens the main body unit and the motor unit is provided, and the positioning pin is a separate body from the fastening member.

9. A scroll-type fluid machine comprising:

a main body unit having a main body casing, a fixed scroll, and an orbiting scroll provided to face the fixed scroll to make an orbiting motion; and a motor unit having a drive shaft connected to the main body unit to drive the main body unit and a motor casing, wherein the drive shaft protrudes from the motor casing and is attached to a slewing bearing of the main body unit, the motor casing and the main body casing have positioning holes into which a positioning pin is inserted on respective mating surfaces, and a dimensional difference in an axial direction between an end surface of the slewing bearing facing a motor casing side and an insertion port of the positioning hole on a main body casing side is smaller than a difference between a protruding dimension of the drive shaft in the axial direction from the insertion port of the positioning hole on the motor casing side and a protruding dimension of the positioning pin from the insertion port of the positioning hole on the motor casing side or on the main body casing side.

10. The scroll-type fluid machine according to claim 9, wherein the drive shaft is attached to the slewing bearing via an eccentric part, and the eccentric part is provided on the motor unit side.

11. The scroll-type fluid machine according to claim 9, wherein a plurality of positioning pins and a plurality of positioning holes are provided in each of the motor casing and the main casing.

12. The scroll-type fluid machine according to claim 11, wherein a dimensional difference in the axial direction between an end surface of the slewing bearing facing the motor casing side and the insertion hole of the positioning hole on the main body casing side is smaller than a difference between a protruding dimension of the drive shaft in the axial direction from the insertion port of the positioning hole on the motor casing side and a protruding dimension of the positioning pin protruding most from the insertion port of the positioning hole on the motor casing side or on the main body casing side.

13. The scroll-type fluid machine according to claim 9, wherein the positioning pin is a stepped pin having a large-diameter part and a small-diameter part having a radial length shorter than the large-diameter part.

14. The scroll-type fluid machine according to claim 9, wherein the positioning hole of the main body casing is disposed separate from a rotation preventing mechanism which prevents rotation of the orbiting scroll.

15. The scroll-type fluid machine according to claim 9, wherein the positioning pin does not have a screw groove.

16. The scroll-type fluid machine according to claim 9, wherein a fastening member which fastens the main body unit and the motor unit is provided, and the positioning pin is a separate body from the fastening member.

17. A method for assembling a fluid machine having a main body unit which expands or compresses a fluid and includes a main body casing, a fixed scroll, and an orbiting scroll provided to face the fixed scroll to make an orbiting motion, and a motor unit including a drive shaft connected to the main body unit to drive the main body unit and a motor casing, wherein after inserting the drive shaft of the motor unit into the main body unit, a positioning pin is inserted into a positioning hole of the motor unit or the main body unit to perform positioning, wherein the drive shaft protrudes from the motor casing and is attached to a slewing bearing of the main body unit, and a dimensional difference in an axial direction between an insertion port of the positioning hole on a main body casing side and an end surface of the slewing bearing facing a motor casing side is configured to be smaller than a dimensional difference in the axial direction between a tip end of the drive shaft on a main body unit side and a tip end of the positioning pin on the main body unit side.

* * * * *